US005857233A

United States Patent [19]

Wynn

[11] Patent Number: 5,857,233

[45] Date of Patent: Jan. 12, 1999

[54] BODY LOTION APPLICATOR

[76] Inventor: Emery G. Wynn, 3 Redmond Dr., Ajax, Ont., Canada, L1S 5R7

[21] Appl. No.: 807,602

[22] Filed: Feb. 27, 1997

[51] Int. Cl.[6] ..... A47L 23/05; A47L 23/06

[52] U.S. Cl. ..... 15/97.1; 15/29; 15/31

[58] Field of Search ..... 15/29, 28, 97.1, 15/97.2, 22.1, 22.2, 23, 31

[56] References Cited

U.S. PATENT DOCUMENTS

| | | | |
|---|---|---|---|
| 4,016,617 | 4/1977 | Cardus | 15/29 |
| 5,165,133 | 11/1992 | Armbruster | 15/97.1 |
| 5,551,114 | 9/1996 | Lee | 15/97.2 |
| 5,680,666 | 10/1997 | Ra | 15/29 |
| 5,784,744 | 7/1998 | Toran | 15/29 |

FOREIGN PATENT DOCUMENTS

| | | | |
|---|---|---|---|
| 2382882 | 11/1978 | France | 15/29 |
| 1503906 | 7/1969 | Germany | 15/29 |

*Primary Examiner*—Gary K. Graham

[57] ABSTRACT

A body lotion applicator including a housing with a handle portion and a head portion. Further provided is a rotating lotion applicator assembly situated within the head portion of the housing including a lotion applicator pad. Also situated within the head portion of the housing is a driving motor adapted for effecting the rotation of the lotion applicator pad upon the actuation thereof. A battery is situated within the handle portion of the housing in electrical communication with the motor via a pair of wires for actuating the motor. Also provided is a mercury switch employed to allow actuation of the motor only when the applicator is situated upright.

4 Claims, 4 Drawing Sheets

BODY LOTION APPLICATOR

BACKGROUND OF THE INVENTION

1. Field of the Invention

The present invention relates to a body lotion applicator and more particularly pertains to evenly applying body lotion with a rotating applicator pad which deactivates upon the inversion of the device.

2. Description of the Prior Art

The use of lotion applicators is known in the prior art. More specifically, lotion applicators heretofore devised and utilized for the purpose of applying lotion to various parts of a body are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,240,339 to DeForest et al.; U.S. Pat. No. 5,322,382 to Hull et al.; U.S. Pat. No. 5,360,111 to Arispe; U.S. Pat. No. 5,445,596 to Grace; U.S. Pat. No. Des. 310,270 to Bacal et al. and U.S. Pat. No. Des. 351,483 to Angeletta.

In this respect, the body lotion applicator according to the present invention substantially departs from the conventional concepts and designs of the prior art, and in so doing provides an apparatus primarily developed for the purpose of evenly applying body lotion with a rotating applicator pad which deactivates upon the inverting of the device.

Therefore, it can be appreciated that there exists a continuing need for a new and improved body lotion applicator which can be used for evenly applying body lotion with a rotating applicator pad which deactivates upon the inverting of the device. In this regard, the present invention substantially fulfills this need.

SUMMARY OF THE INVENTION

In view of the foregoing disadvantages inherent in the known types of lotion applicators now present in the prior art, the present invention provides an improved body lotion applicator. As such, the general purpose of the present invention, which will be described subsequently in greater detail, is to provide a new and improved body lotion applicator which has all the advantages of the prior art and none of the disadvantages.

To attain this, the present invention essentially comprises a housing with a handle portion and a head portion. The handle portion has a hollow cylindrical configuration defining a battery compartment with a lower open end. As shown in FIG. 6, the lower open end has a plurality of threaded grooves formed therein for allowing the removable coupling of a cap. The cap includes an eyelet for allowing the attachment of a close loop string thereto. The handle portion further has a corrugated outer surface for gripping purposes. The head portion of the housing is constructed with a circular configuration having a top face, a bottom face, and a periphery formed therebetween. Such periphery is tangentially and integrally coupled to an upper end of the handle portion. As best shown in FIG. 6, the bottom face has a circular opening formed therein defining an interior space. The circular opening has an annular lip formed along a periphery thereof which extends radially inwardly in coplanar relationship with the bottom face. The top face also has a circular opening formed therein. Such circular opening is constructed in coaxial relationship with the circular opening of the bottom face. As shown in FIG. 6, the circular opening of the top face has a smaller diameter than that of the circular opening of the bottom face and both circular openings are in communication within the head portion of the housing. Further provided is a rotating lotion applicator assembly. With reference still to FIG. 6, the lotion applicator assembly includes a lotion applicator pad mounting ring situated within the circular opening of the bottom face of the head portion of the housing. Such ring is in sliding relationship with the lip and is equipped with a ring of teeth formed in a top face thereof. Note FIG. 7. To facilitate the application of lotion, the rotating lotion applicator assembly also includes a disk-shaped lotion applicator pad permeable to lotion. The applicator pad is coupled to an inner circumference of the lotion applicator pad mounting ring such that a lower surface of the lotion applicator pad extends beyond the bottom face of the head portion of the housing. For containing the lotion and further dispensing it to the applicator pad, the rotating lotion applicator assembly includes a rotating lotion dispensing portion. The lotion dispensing portion has a lower extent with a hollow frusto-conical configuration. A base of the lower extent is integrally coupled along a periphery thereof to the lotion applicator pad mounting ring. Associated therewith is an intermediate extent formed of a tube integrally coupled in coaxial relationship with a top of the lower extent. The lotion dispensing portion further has a top extent formed of a reservoir which has an opening in a bottom face extent thereof which is in communication with the intermediate extent. Another opening is formed in a top face of the top extent with an associated cap for allowing selective access therein via the circular opening of the top face of the head portion of the housing. By this structure, lotion may flow to the lotion applicator pad from the top extent of the rotating lotion applicator assembly thereby saturating the pad with lotion. Further provided is a driving motor situated within the head portion of the housing with a stator fixed with respect to the head portion. The motor further includes a rotor having a gear coupled thereto for engaging the ring of teeth of the lotion applicator pad mounting ring. As such, upon the driving motor being actuated, the entire lotion applicator assembly rotates thereby effecting the agitation of the lotion and allowing the application thereof evenly on a body of a user. For powering purposes, a battery is situated within the battery compartment of the handle portion of the housing in electrical communication with the motor via a pair of wires for actuating the motor. As shown in FIGS. 6 & 8, a mercury switch is electrically connected between the motor and the battery. The mercury is adapted to allow the actuation of the motor upon the head portion of the housing being situated above the handle portion thereof. The mercury is further adapted to preclude the actuation of the motor upon the head portion of the housing being situated below the handle portion thereof. Finally, a disk-shaped protective cap is provided with an annular flange extending outwardly therefrom. Such flange is adapted for frictionally engaging the circular opening of the bottom face thereby protecting the lotion applicator pad when not in use.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved body lotion applicator which has all the advantages of the prior art lotion applicators and none of the disadvantages.

It is another object of the present invention to provide a new and improved body lotion applicator which may be easily and efficiently manufactured and marketed.

It is a further object of the present invention to provide a new and improved body lotion applicator which is of a durable and reliable construction.

An even further object of the present invention is to provide a new and improved body lotion applicator which is susceptible of a low cost of manufacture with regard to both materials and labor, and which accordingly is then susceptible of low prices of sale to the consuming public, thereby making such body lotion applicator economically available to the buying public.

Still yet another object of the present invention is to provide a new and improved body lotion applicator which provides in the apparatuses and methods of the prior art some of the advantages thereof, while simultaneously overcoming some of the disadvantages normally associated therewith.

Still another object of the present invention is to evenly apply body lotion with a rotating applicator pad which deactivates upon the inversion of the device.

Lastly, it is an object of the present invention to provide a new and improved body lotion applicator including a housing with a handle portion and a head portion. Further provided is a rotating lotion applicator assembly situated within the head portion of the housing including a lotion applicator pad. Also situated within the head portion of the housing is a driving motor adapted for effecting the rotation of the lotion applicator pad upon the actuation thereof. A battery is situated within the handle portion of the housing in electrical communication with the motor via a pair of wires for actuating the motor. Also provided is a mercury switch employed to allow actuation of the motor only when the applicator is situated upright.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
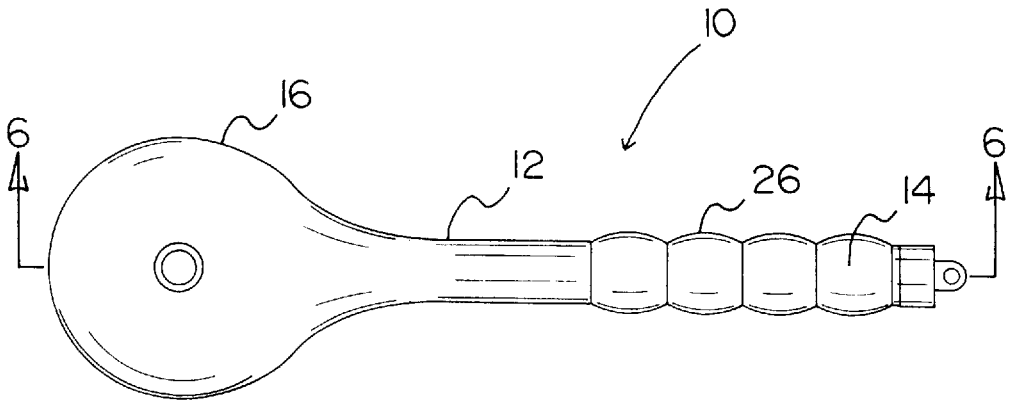
FIG. 1 is a perspective illustration of the preferred embodiment of the body lotion applicator constructed in accordance with the principles of the present invention.
Figure 2:
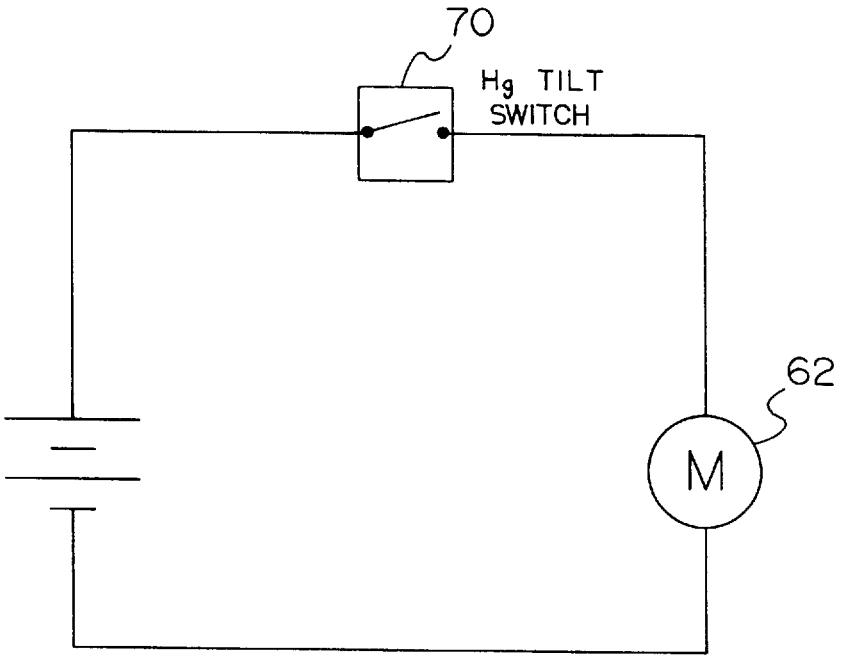
FIG. 2 is a schematic diagram depicting the interconnection of the motor, mercury switch, and battery.
Figure 3:
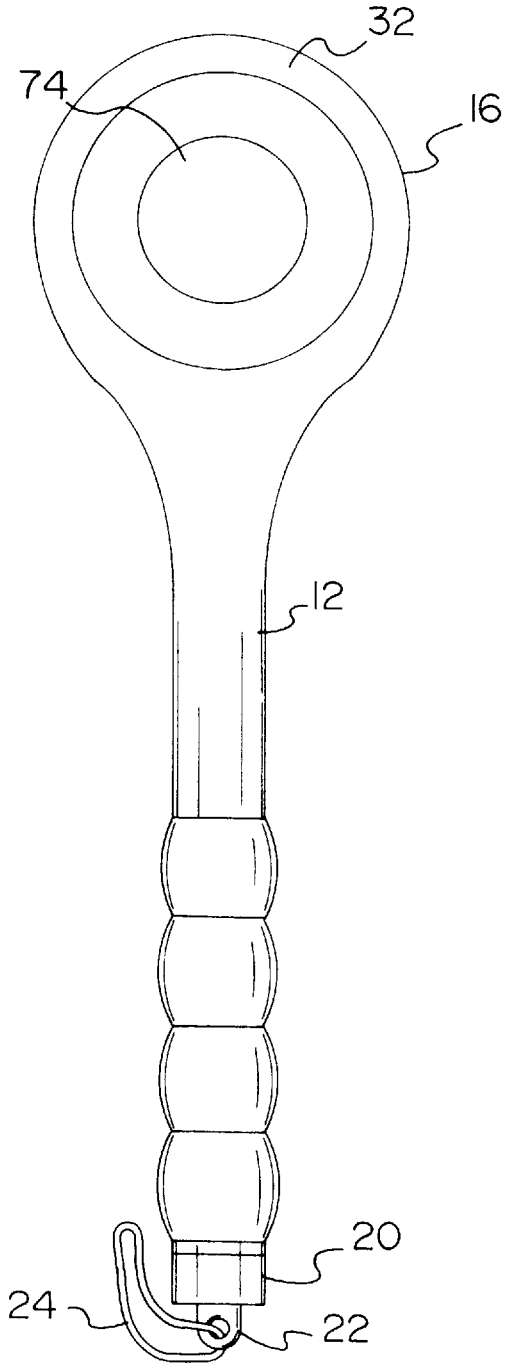
FIG. 3 is a bottom view of the housing of the present invention with the protective cap in place.
Figure 4:
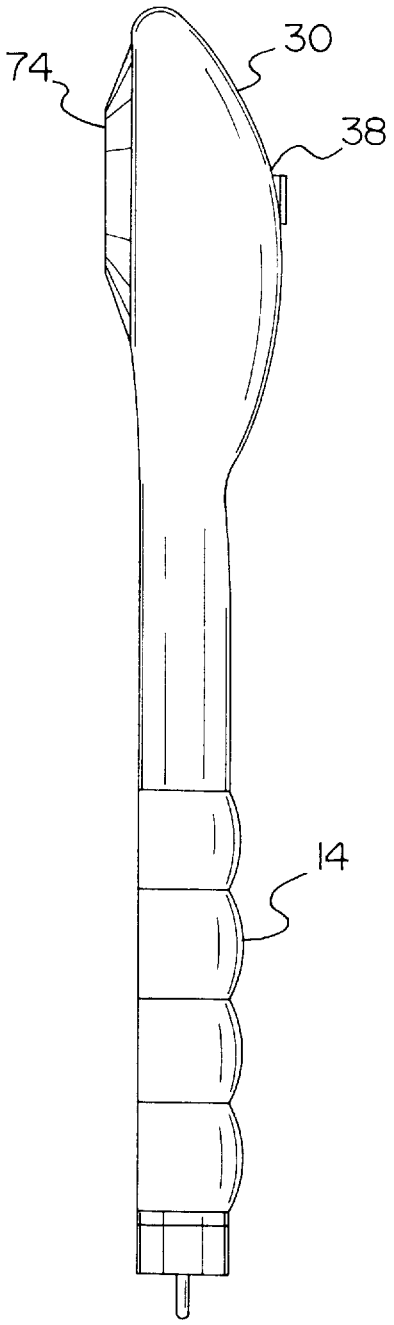
FIG. 4 is a side view of the present invention.
Figure 5:
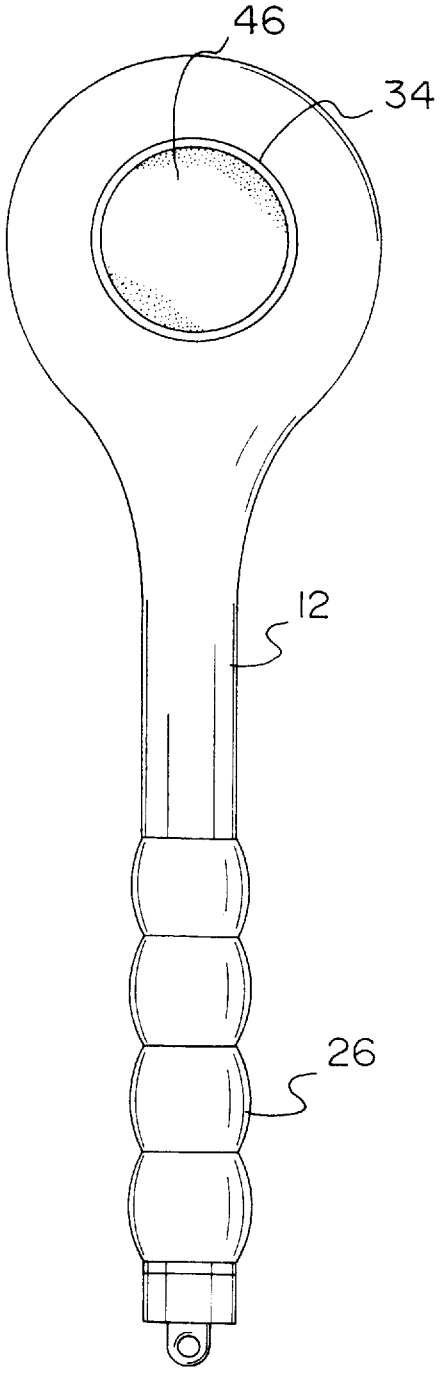
FIG. 5 is a bottom view of the present invention with the protective cap removed.

With reference now to the drawings, and in particular to FIG. 1 thereof, a new and improved body lotion applicator embodying the principles and concepts of the present invention and generally designated by the reference numeral 10 will be described.

The present invention, the new and improved body lotion applicator, is comprised of a plurality of components. Such components in their broadest context include a housing, lotion application assembly, motor, battery, mercury switch, and protective cap. Such components are individually configured and correlated with respect to each other so as to attain the desired objective.

Figure 6:
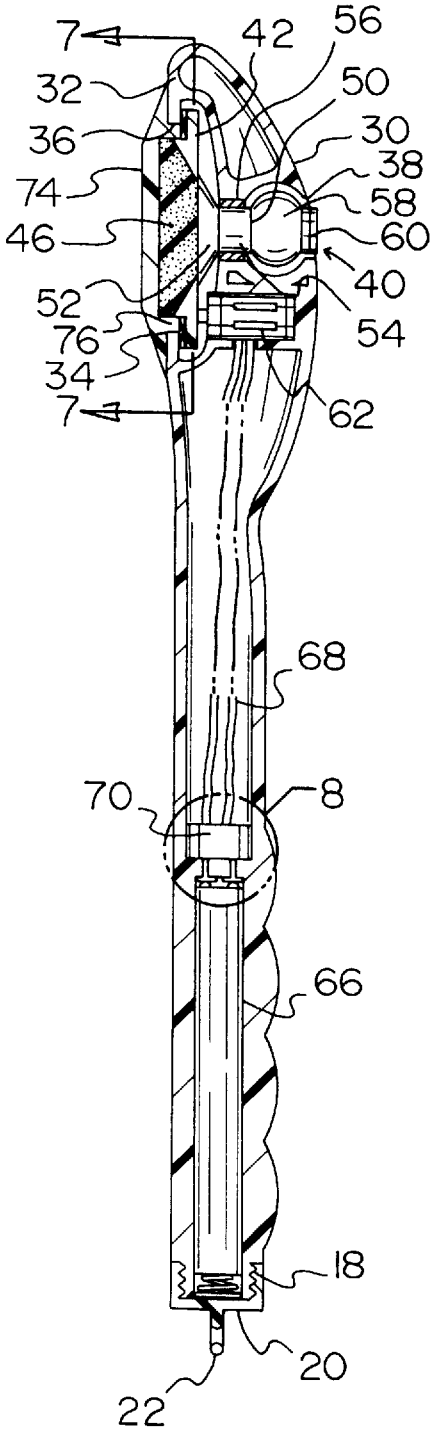
FIG. 6 is a cross-sectional view of the present invention taken along line 6—6 shown in FIG. 1.

More specifically, it will be noted that the system 10 of the present invention includes a housing 12 with a handle portion 14 and a head portion 16. The housing is preferably constructed of a rigid plastic. The handle portion has a hollow cylindrical configuration defining a battery compartment with a lower open end. As shown in FIG. 6, the lower open end has a plurality of threaded grooves 18 formed therein for allowing the removable coupling of a cap 20. The cap includes an eyelet 22 for allowing the attachment of a close loop string 24 thereto. The handle portion further has a corrugated outer surface 26 for gripping purposes.

The head portion of the housing is constructed with a circular configuration having a top face 30, a bottom face 32, and a periphery formed therebetween. Such periphery is tangentially and integrally coupled to an upper end of the handle portion. As best shown in FIG. 6, the bottom face has a circular opening 34 formed therein defining an interior space. The circular opening has an annular lip 36 formed along a periphery thereof and extends radially inwardly in coplanar relationship with the bottom face. The top face also has a circular opening 38 formed therein. Such circular opening is constructed in coaxial relationship with the circular opening of the bottom face. As shown in FIG. 6, the circular opening of the top face has a smaller diameter than that of the circular opening of the bottom face and both circular openings are in communication within the head portion of the housing.

Further provided is a rotating lotion applicator assembly 40. With reference still to FIG. 6, the lotion applicator assembly includes a lotion applicator pad mounting ring 42 situated within the circular opening of the bottom face of the head portion of the housing. Such ring is in sliding relationship with the lip and is equipped with a ring of teeth 44 formed in a top face thereof. Note FIG. 7. To facilitate the application of lotion, the rotating lotion applicator assembly also includes a disk-shaped lotion applicator pad 46 permeable to lotion. The applicator pad is coupled to an inner circumference of the lotion applicator pad mounting ring such that a lower surface of the lotion applicator pad extends beyond the bottom face of the head portion of the housing. As shown in FIG. 6, the bottom face of the lotion applicator pad mounting ring is bevelled to provide increased surface area to which the applicator pad is coupled.

For containing the lotion and further dispensing it to the applicator pad, the rotating lotion applicator assembly includes a rotating lotion dispensing portion 50. The lotion dispensing portion has a lower extent 52 with a hollow frusto-conical configuration. A base of the lower extent is integrally coupled along a periphery thereof to the lotion applicator pad mounting ring. Associated therewith is an intermediate extent 54 formed of a tube integrally coupled in coaxial relationship with a top of the lower extent. As can be seen from FIG. 6, an annular bushing 56 is slidably positioned about the outer surface of the intermediate extent thereby working conjunction with the lip of the opening of the bottom face to only allow rotational movement of the lotion dispensing portion and further preclude lateral or longitudinal shifting. The lotion dispensing portion further has a top extent 58 formed of a reservoir which has an opening in a bottom face extent thereof which is in communication with the intermediate extent. As shown in FIG. 6, the top extent has a spherical configuration. Another opening is formed in a top of the top extent with an associated cap 60 for allowing selective access therein via the circular opening of the top face of the head portion of the housing. By this structure, lotion may flow to the lotion applicator pad from the top extent of the rotating lotion applicator assembly thereby saturating the pad with lotion.

Figure 7:
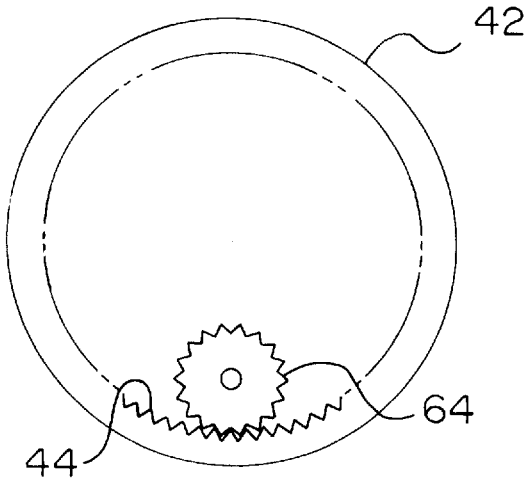
FIG. 7 is a cross-sectional view of the present invention taken along line 7—7 shown in FIG. 6.

Further provided is a driving motor 62 situated within the head portion of the housing with a stator fixed with respect to the head portion. The motor further includes a rotor having a gear 64 coupled thereto for engaging the ring of teeth of the lotion applicator pad mounting ring. As such, upon the driving motor being actuated, the entire lotion applicator assembly rotates thereby effecting the agitation and distribution of the lotion and allowing the application thereof evenly on a body of a user. As can be seen in FIG. 7, the gear of the rotor is of a smaller diameter than the ring of teeth thus affording the proper amount of torque to the applicator pad. It should further be noted that the gear 64 is small so as to not interfere with the coupling of the lower extent of the lotion applicator assembly and the mounting ring.

For powering purposes, a battery 66 is situated within the battery compartment of the handle portion of the housing in electrical communication with the motor via a pair of wires 68 for actuating the motor. Preferably, such battery is of a rechargeable nature.

Figure 8:
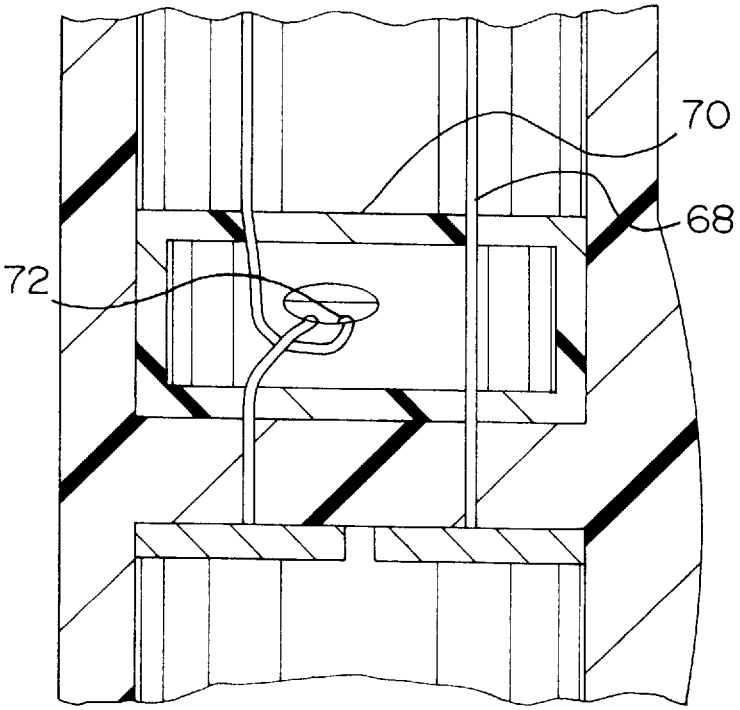
FIG. 8 is a close-up view of the mercury switch shown in FIG. 6.

As shown in FIGS. 6 & 8, a mercury switch 70 is electrically connected between the motor and the battery. The mercury is adapted to allow the actuation of the motor upon the head portion of the housing being situated above the handle portion thereof. The mercury is further adapted to preclude the actuation of the motor upon the head portion of the housing being situated below the handle portion thereof. To accomplish such, the mercury switch is position in the handle portion of the housing with a pair of contacts 72 positioned on a bottom surface of the mercury container associated with the mercury switch. Note FIG. 8.

Finally, a disk-shaped protective cap 74 is provided with an annular flange 76 extending outwardly therefrom. Such flange is adapted for frictionally engaging the circular opening of the bottom face thereby protecting the lotion applicator pad when not in use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved body lotion applicator comprising, in combination:

a housing with a handle portion having a hollow cylindrical configuration defining a battery compartment with a lower open end having a plurality of threaded grooves formed therein for allowing the removable coupling of a cap, the cap having an eyelet formed therein, the handle portion further having a corrugated outer surface for gripping purposes, the housing further including a head portion with a circular configuration having a top face, a bottom face, and a periphery formed therebetween which is integrally coupled to an upper end of the handle portion, the bottom face having a circular opening formed therein defining an interior space, the circular opening having an annular lip formed along a periphery thereof and extending radially inwardly in coplanar relationship with the bottom face, the top face having a circular opening formed therein in coaxial relationship with the circular opening of the bottom face, wherein the circular opening of the top face has a smaller diameter than that of the circular opening of the bottom face and both circular openings are in communication within the head portion of the housing;

a rotating lotion applicator assembly including a lotion applicator pad mounting ring situated within the circular opening of the bottom face of the head portion of the housing in sliding relationship with the lip thereof, the lotion applicator pad mounting ring having a ring of teeth formed in a top face thereof, the rotating lotion applicator assembly also including a disk-shaped lotion applicator pad permeable to lotion coupled to an inner circumference of the lotion applicator pad mounting ring such that a lower surface of the lotion applicator pad extends beyond the bottom face of the head portion of the housing, the rotating lotion applicator assembly further including a rotating lotion dispensing portion having a lower extent with a hollow frusto-conical configuration with a base thereof integrally coupled along a periphery thereof to the lotion applicator pad mounting ring, an intermediate extent formed of a tube integrally coupled in coaxial relationship with a top of the lower extent, and a top extent formed of a reservoir which has an opening in a bottom face extent thereof in communication with the intermediate extent and another opening in a top face thereof with an associated cap for allowing selective access therein via the circular opening of the top face of the head portion of the housing, whereby lotion may flow to the lotion applicator pad from the top extent of the rotating lotion applicator assembly thereby saturating the pad with lotion;

a driving motor situated within the head portion of the housing with a stator fixed with respect to the head portion and a rotor having a gear coupled thereto for engaging the ring of teeth of the lotion applicator pad mounting ring, whereby upon the driving motor being actuated, the entire lotion applicator assembly rotates thereby effecting the agitation of the lotion and allowing the application thereof evenly on a body of a user;

a battery situated within the battery compartment of the handle portion of the housing in electrical communication with the motor via a pair of wires for actuating the motor;

a mercury switch electrically connected between the motor and the battery, the mercury switch adapted to allow the actuation of the motor upon the head portion of the housing being situated above the handle portion thereof, the mercury further adapted to preclude the actuation of the motor upon the head portion of the housing being situated below the handle portion thereof; and a disk-shaped protective cap with an annular flange extending outwardly therefrom for frictionally engaging the circular opening of the bottom face thereby protecting the lotion applicator pad when not in use.

2. A body lotion applicator comprising:

a housing with a handle portion and a head portion, wherein the head portion is constructed with a circular configuration having a top face, bottom face, and a periphery formed therebetween which is integrally coupled to an upper end of the handle portion, the bottom face having a circular opening formed therein defining an interior space, the circular opening having an annular lip formed along a periphery thereof and extending radially inwardly in coplanar relationship with the bottom face, the top face having a circular opening formed therein in coaxial relationship with the circular opening of the bottom face, wherein the circular opening of the top face has a smaller diameter than that of the circular opening of the bottom face and both circular openings are in communication within the head portion of the housing;

a rotating lotion applicator assembly situated within the head portion of the housing including a disk-shaped lotion applicator pad supported in a lotion applicator pad mounting ring situated within the circular opening of the bottom face of the head portion of the housing in sliding relationship with the lip thereof, the lotion applicator pad mounting ring having a ring of teeth formed in a top face thereof, the disk-shaped lotion applicator pad permeable to lotion and coupled to an inner circumference of the lotion applicator pad mounting ring, the rotating lotion applicator assembly further including a rotating lotion dispensing portion having a lower extent with a hollow frusto-conical configuration with a base thereof integrally coupled along a periphery thereof to the lotion applicator pad mounting ring, an intermediate extent formed of a tube integrally coupled in coaxial relationship with a top of the lower extent, and a top extent formed of a reservoir which has an opening in a bottom face extent thereof in communication with the intermediate extent and another opening in a top face thereof with an associated cap for allowing selective access therein via the circular opening of the top face of the head portion of the housing, whereby lotion may flow to the lotion applicator pad from the top extent of the rotating lotion applicator assembly thereby saturating the pad with lotion;

a driving motor adapted for effecting the rotation of the lotion applicator pad upon the driving motor being actuated;

a battery in electrical communication with the motor via a pair of wires for actuating the motor.

3. A body lotion applicator as set forth in claim 2 and further including a mercury switch electrically connected between the motor and the battery, the mercury switch adapted to allow the actuation of the motor upon the head portion of the housing being situated above the handle portion thereof, the mercury switch further adapted to preclude the actuation of the motor upon the head portion of the housing being situated below the handle portion thereof.

4. A body lotion applicator as set forth in claim 2 and further including a disk-shaped protective cap for engaging the head portion thereby protecting the lotion applicator pad when not in use.

* * * * *